United States Patent [19]

Esser, III

[11] Patent Number: 4,542,631

[45] Date of Patent: Sep. 24, 1985

[54] JEWELRY AND THE LIKE ADAPTED TO DEFINE A PLURALITY OF OBJECTS OR SHAPES

[76] Inventor: William L. Esser, III, 4107 Cocoanut Rd., Lake Worth, Fla. 33461

[21] Appl. No.: 552,296

[22] Filed: Nov. 16, 1983

[51] Int. Cl.[4] ..... A44C 25/00

[52] U.S. Cl. ..... 63/31; 63/23; 63/18; 40/1.6; 206/457

[58] Field of Search ..... 63/1, 2, 18, 19, 31, 63/23, 20; D11/2; 206/37, 457, 530, 540; 40/152, 154, 155, 1.6; 273/153 S, 155

[56] References Cited

U.S. PATENT DOCUMENTS

| | | | |
|---|---|---|---|
| D. 14,549 | 1/1884 | Pine . | |
| D. 59,244 | 10/1921 | McAvoy . | |
| D. 59,529 | 10/1921 | Weed . | |
| D. 59,612 | 11/1921 | Tennefass . | |
| D. 66,742 | 3/1925 | Nelson . | |
| D. 113,506 | 2/1939 | Burke . | |
| D. 121,261 | 6/1940 | Silson . | |
| D. 135,053 | 2/1943 | Lampl . | |
| D. 136,753 | 11/1943 | Lyon . | |
| D. 137,006 | 1/1944 | Pereira . | |
| D. 167,388 | 8/1952 | Blecher . | |
| D. 169,677 | 5/1953 | Katz . | |
| D. 246,353 | 11/1977 | Elkaim . | |
| D. 247,881 | 5/1978 | Hitchens . | |
| 264,447 | 9/1882 | Draper | 63/18 |
| D. 266,408 | 10/1982 | Dotson . | |
| 311,331 | 1/1885 | LaForge et al. | 63/19 |
| 420,508 | 2/1890 | Blassing | 63/23 |
| 768,120 | 8/1904 | Fisher | 63/19 |
| 800,576 | 9/1905 | Higgins . | |
| 811,693 | 2/1906 | Calvo . | |
| 1,032,257 | 7/1912 | Walrow | 63/23 |
| 1,412,943 | 4/1922 | Kennedy . | |
| 1,638,743 | 8/1927 | Peterson et al. | 63/23 |
| 1,817,562 | 2/1929 | Hodge . | |
| 2,358,194 | 7/1943 | White . | |
| 2,391,347 | 6/1943 | Punte . | |
| 2,408,150 | 9/1944 | Moeller . | |
| 2,877,506 | 3/1959 | Olmoslino | 273/155 |
| 3,025,952 | 3/1962 | Phipps . | |
| 3,377,819 | 4/1968 | Joy et al. | 63/31 |
| 3,638,830 | 2/1972 | Belokin, Jr. . | |
| 3,954,179 | 5/1976 | Warmath . | |
| 3,995,447 | 12/1976 | Levsunov | 63/31 X |
| 4,005,865 | 2/1977 | Kidder . | |
| 4,065,132 | 12/1977 | Giakas . | |
| 4,261,468 | 4/1981 | Krebs . | |
| 4,333,652 | 6/1982 | Clancy . | |
| 4,378,116 | 3/1983 | Rubik . | |
| 4,392,323 | 7/1983 | Rubik | 273/153 S |
| 4,420,076 | 12/1983 | Beveridge et al. | 206/540 |

FOREIGN PATENT DOCUMENTS

| | | | |
|---|---|---|---|
| 705352 | 9/1931 | France | 63/31 |
| 13941 | of 1905 | United Kingdom | 63/18 |
| 6604 | of 1909 | United Kingdom | 63/18 |

*Primary Examiner*—F. Barry Shay

*Attorney, Agent, or Firm*—Hedman, Gibson, Costigan & Hoare

[57] ABSTRACT

A novelty which can be used as jewelry, pendants, pill or jewelry boxes, lockets and the like. The novelty includes a pair of opposed lobes which, when mated together, form a heart, and upon rotation of one lobe 180 degrees forms an ellipse. A pivoting means maintains the lobes tightly compressed while permitting rotation thereof. Compartments and chambers can be provided to permit the device to be used as a pillbox or a locket, as well as a piece of jewelry.

11 Claims, 19 Drawing Figures

JEWELRY AND THE LIKE ADAPTED TO DEFINE A PLURALITY OF OBJECTS OR SHAPES

BACKGROUND OF THE INVENTION

1. Field of the Invention

This invention relates to jewelry, charms, pendants, pillboxes, lockets and the like adapted to define an object whose shape can be changed or disguised. More particularly, this invention includes a multi-lobed, heart shaped object whose lobes can be moved relative to one another to change or disguise the preferred shape.

2. Description of the Prior Art

Jewelry, charms, lockets, key chain fobs, and the like in the shape of a heart are well known. However, the prior art heart shaped items are fixed or immutable. Their shape cannot be disguised to surprise or baffle anyone, nor can the shape be changed to suit the mood or whim of the wearer. In each instance, nothing can be done except to give and wear the heart shaped item. The giver of the item is deprived of surprising and baffling the recipient, and the owner is deprived of changing the shape of the item as desired.

SUBJECT OF THE INVENTION

It is one object of the invention to provide a novelty device that can be used as jewelry or the like, wherein the shape can be changed easily, such as from a heart to an ellipse by rotating one part of the device to another part thereof.

Among the other objects of the invention is to provide the described device with a jewelry or pillbox, a locket for photographs, or means which can permit the device to be used as a key chain fob.

In accordance with the invention, there is provided a novelty which can be incorporated into jewelry and the like, comprising a plurality of parts which can be moved relative to one another to change the shape of the novelty as desired.

In a preferred embodiment, the novelty is a pivotally interconnected multi-lobe piece of jewelry which desirably is heart shape but which can be changed or disguised in shape as desired. For example, the novelty item or device can be easily changed from a heart to an ellipse. More particularly, the novelty includes two lobes each of which is the opposing half of a heart shape. The lobes generally are parabolic in configuration with a plane end opposite the apex of the parabola. The lobes are mated together along the plane ends and maintained in position by a pivoting means which interconnect the lobes. The pivoting means provides a rotational axis which allows the lobes to be rotated 360 degrees relative to one another. The lobes are configurated such that when one is rotated 180 degrees, either an ellipse or a heart is formed. Thus, there are two positions, a heart shape position and an elliptical shape position thereby creating two pieces of jewelry in one, having a neat and attractive appearance.

In one embodiment, the pivoting means includes a set screw, a machine bolt enclosed by a spring and a screw cap. One lobe has a threaded bore centered both horizontally and vertically to receive a set screw and bolt. The other lobe has a central bore which is partially threaded and of three different diameters. The first bore diameter is adjacent the plane end and allows only the bolt to pass through but not the spring. The second bore diameter is adjacent to and larger than the first diameter to accept the spring. The third diameter extends from the second diameter to the outer surface of the lobe and is threaded to accept the screw cap. To assemble the pivoting means, the set screw is screwed into the threaded bore, the bolt enclosed by the spring is passed through the bore of the other lobe and screwed into the threaded bore and the cap screw is then inserted. The spring maintains a tight fit between the lobes with adjustments being made by the position of the set screw. Thus, the lobes can be easily rotated about the pivoting means into the desired positions.

A second embodiment includes a pivoting means which is hidden from view when the novelty is in either the heart or elliptical positions. One lobe has a threaded bore to receive a set screw. The second lobe includes a recess adjacent the plane end to receive a pivot plate and a bore which encloses a spring and locknut. The set screw consists of a short threaded length, a central unthreaded section and a longer threaded length. The set screw is threaded into the threaded bore with the longer threaded length protruding from the plane end. The pivot plate is slipped over the protruding length of the set screw followed by the spring and locknut. The pivot plate, spring and locknut are inserted in the second lobe while perpendicular to the first lobe. The pivot plate is secured to the second lobe by two maintaining screws. Therefore, when the lobes are rotated to the heart and ellipse positions the pivoting means cannot be seen.

The lobes can be provided with name inscriptions or with various designs. For example, the lobes can include a plurality of straight or curved lines which may be provided by manufacturing the device with inlaid materials. The lines are symmetrically arranged such that whether the device is in the heart or ellipse position, the lines meet at the plane ends of the lobes. When names are inscribed, the device can be very versatile. While in one position, for instance the ellipse, the first and last name of the wearer can be displayed. Then, when the device is rotated to the heart position, the first name of the wearer and friend will appear.

In another embodiment of the invention, at least one lobe contains a chamber with an opening intermediate the plane end. A movable cap is recessed into each chamber and covers the opening. Access is gained to each chamber when the lobes are rotated to a position perpendicular to each other. The device according to this embodiment is especially useful as a pillbox.

The jewelry and the like of the present invention also can be used as a photo-keeper or jewelry box. Each lobe can be provided with opposing compartments having slidably hinged covers. For use as a photo-keeper, the compartments are only deep enough to maintain a photograph or the like. Thus, a total of four photographs may be kept in the device. To be used as a jewelry box, the compartments are deeper to permit storage of assorted jewelry, and, preferably, only one compartment is provided in each lobe.

BRIEF DESCRIPTION OF THE DRAWINGS

FIG. 11 is a front view of the device of the invention, wherein the lobes have hinged covers and recesses for photographs and the like.

DETAILED DESCRIPTION OF ILLUSTRATIVE EMBODIMENTS

Figure 1:
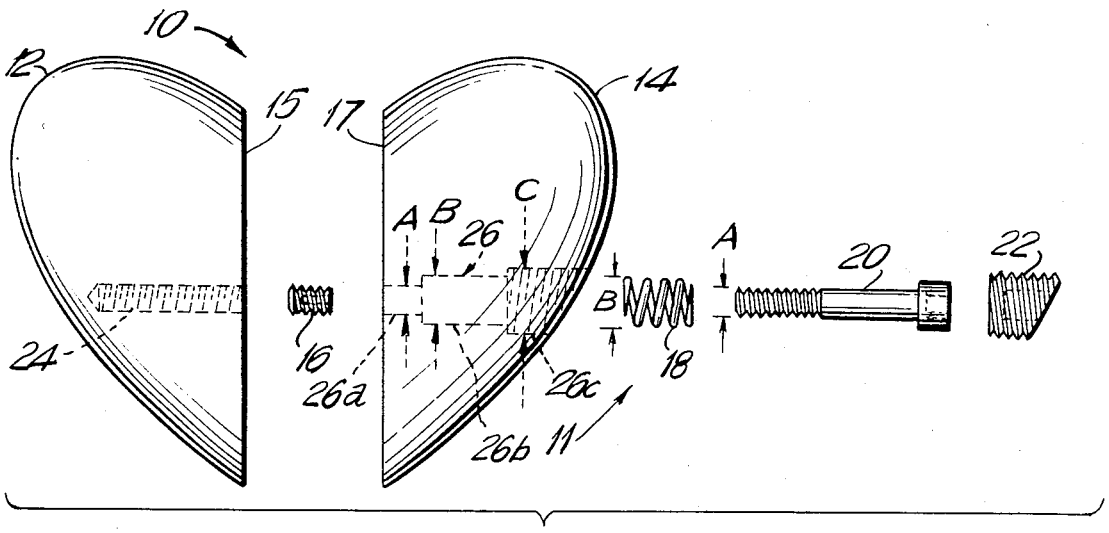
FIG. 1 is an exploded view of the multi-lobe heart shape/elliptical device of the invention.
Figure 2:
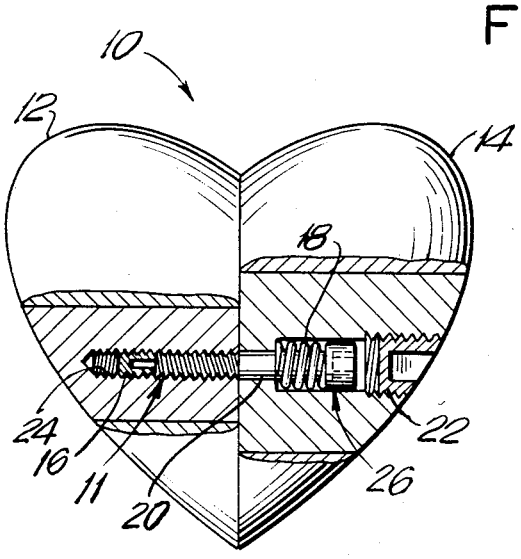
FIG. 2 is a front view, partly in section, of the device of FIG. 1 showing the device in its heart shape position with the assembled pivoting means.
Figure 3:
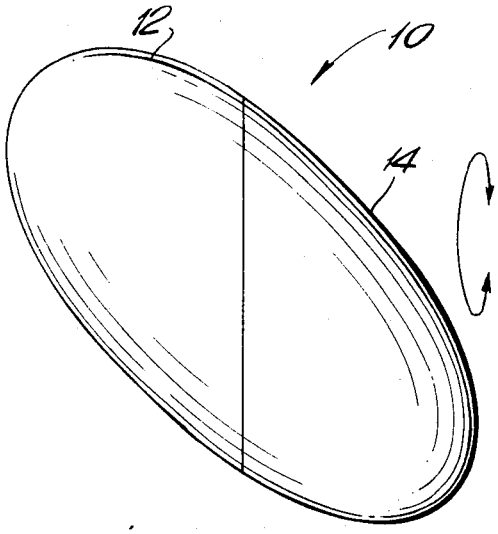
FIG. 3 is a front view of the device of FIG. 1 showing the device in its elliptical position.
Figure 4:
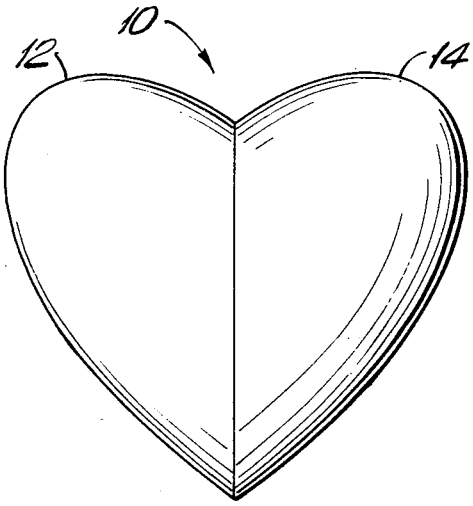
FIG. 4 is a front view of the device of FIG. 1 showing the device in the heart shape position.

Referring now to FIGS. 1–5, there is shown a preferred embodiment of the novelty 10 which includes a pair of opposed arcuate lobes 12 and 14 that generally have a parabolic configuration. As shown in FIG. 1, the lobes 12, 14 are opposite halves of a heart shape each having a plane end 15, 17. However, when properly positioned as shown in FIG. 3, the lobes 12, 14 are also opposite halves of an ellipse.

Referring again to FIG. 1, there is shown in exploded view, the pivoting means to allow the novelty 10 to be rotated from its heart shape position to its elliptical position. The pivoting means includes a set screw 16, spring 18, bolt 20 and cap screw 22. Lobe 12 includes a threaded bore 24 to receive set screw 16 and bolt 20. Lobe 14 includes partially threaded through bore 26 having three sections with different diameters. Section **26*a* has a diameter A which allows bolt 20, also of diameter A, to pass through. Section 26*b* has a diameter B equal to the diameter of spring 18. Diameter A is smaller than B to prevent spring 18 from passing through section 26*a*. When compressed, spring 18 provides a tight fit between the lobes 12 and 14. Threaded section 26*c*, having diameter C is larger than B and accepts cap screw 22 to maintain the bolt 20 in place. The pivoting means must be centered both horizontally and vertically within the lobes 12 and 14** to allow for the proper positioning after rotation thereof.

Figure 5:
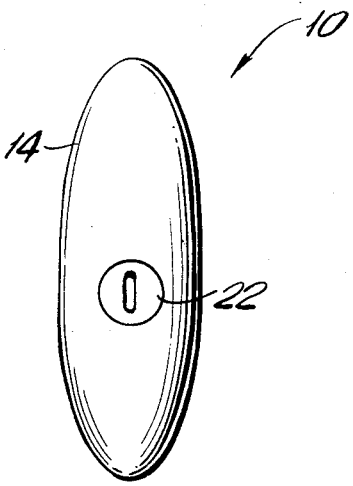
FIG. 5 is a side view of the device of FIG. 1 showing the cap screw which permits access to the pivoting means.

The assembled novelty 10 is shown in FIG. 2, wherein the lobes 12 and 14 are mated together so that plane ends 15 and 17 are contiguous to each other. The set screw 16 is threaded into the bore 24 of the lobe 12. The bolt 20, enclosed by spring 18, is passed through the bore 26 in the lobe 14 and threaded into the bore 24 of the lobe 12. The position of the set screw 16 will determine the amount the spring 18 is compressed. The spring 18 should be compressed sufficiently enough to provide a tight frictional fit between the lobes 12 and 14, yet loose enough to allow the lobes to be rotated relative to each other. The cap screw 22 is threaded into the bore 26 to maintain the bolt 20 in place as shown in FIGS. 2 and 5. Thus, the novelty 10 may be rotated to a first or "mystery" position in the shape of an ellipse as shown in FIG. 3. Then, when desired, one lobe is rotated 180 degrees in either direction to a second or heart position to produce the heart shape shown in FIG. 4.

Figure 12:
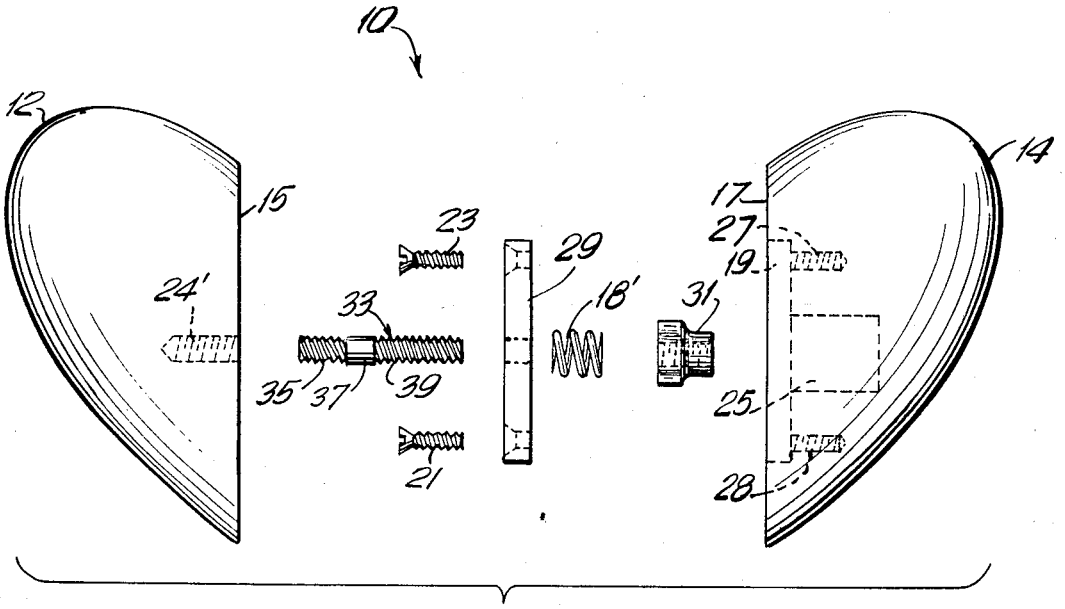
FIG. 12 is an exploded view of the device showing a second pivoting means.
Figure 13:
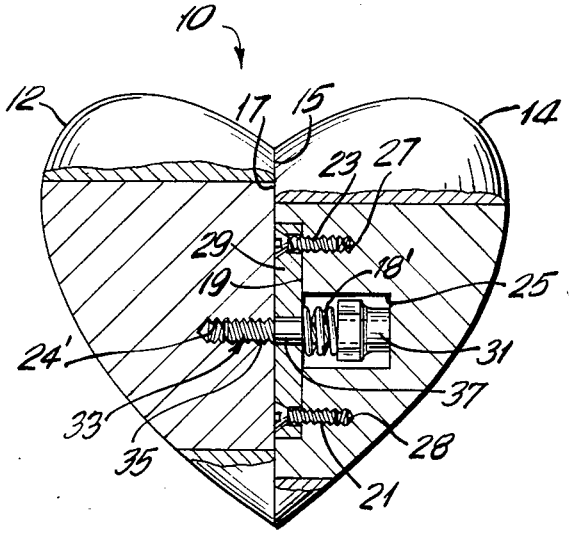
FIG. 13 is a front view, partly sectioned, of the device of FIG. 12.

In another embodiment, as shown in FIGS. 12 and 13, an alternative pivoting means is employed. Lobe 12 has a threaded bore 24' and lobe 14 has a bore 25, threaded bores 27 and 28, and a recess 19. One end of a set screw 33 is threaded into the threaded bore 24', and a pivot plate 29 is slipped over the portion of set screw 33 protruding beyond plane end 15 of the lobe 12. Set screw 33 includes a first threaded section 35, central unthreaded section 37 and protruding threaded section 39. Protruding threaded section 39 is generally longer than first threaded section 35. Spring 18' is then slipped over the other end of the set screw 33 and a locknut 31 is screwed onto the set screw 33 tight enough to provide the tight frictional fit discussed above. With the pivot plate 29 and the lobe 14 positioned perpendicular to lobe 12, locknut 31 and spring 18' are interposed into bore 25 and pivot plate 29 is seated into recess 19. Mounting screws 23 and 25 are threaded into the threaded bores 27 and 28 respectively to complete the assembly. Hence, when the novelty 10 is in either the heart or mystery positions the pivoting means is hidden from view.

Figure 6:
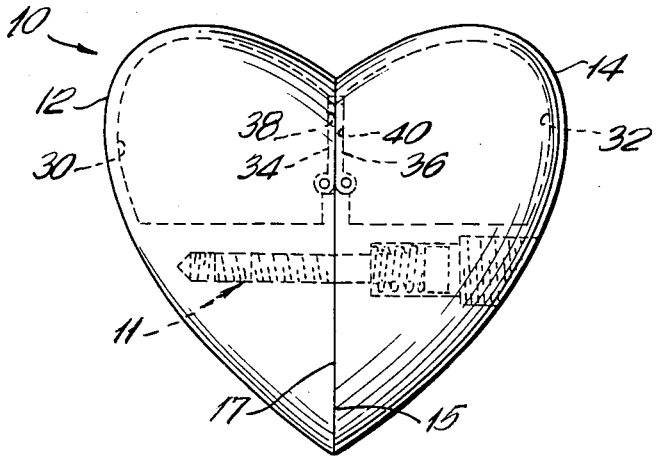
FIG. 6 illustrates another embodiment of the invention wherein the device is used as a pillbox with the compartments therefor shown by the phanthom lines.
Figure 6A:
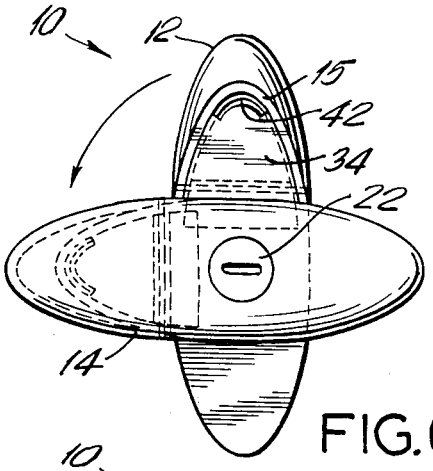
FIG. 6A is a side view of the device of FIG. 6 illustrating rotation of one lobe to allow access to a compartment.
Figure 6B:
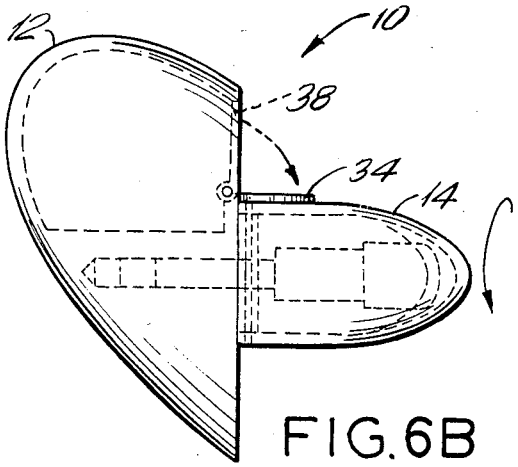
FIG. 6B is a front view of the device shown in FIG. 6.

Referring now to FIGS. 6, 6A and 6B, there is shown the novelty 10 of the invention in the form of a pillbox, small jewelry box or the like. In the embodiment, the novelty 10 comprises lobes 12 and 14 having plane ends 15 and 17 and chambers 30 and 32, respectively. A pivoting means 11 similar to that shown in FIGS. 1–5 also is included. Each chamber 30, 32 has a cap 34, 36 respectively, recessed into and covering openings 38, 40 in chamber 30, 32. A finger catch 42 is provided for ease in opening caps 34 and 36. Access to the chambers 30 and 32 is achieved by rotating the lobes 12 and 14 to a position perpendicular to each other, as shown in FIGS. 6A and 6B. When the device 10 is in either the heart or ellipse positions, it is not apparent that the novelty 10 includes a pillbox, jewelry box or the like. Thus, the novelty 10 is especially useful as a pillbox or the like while also being a handsome piece of jewelry.

Figure 7:
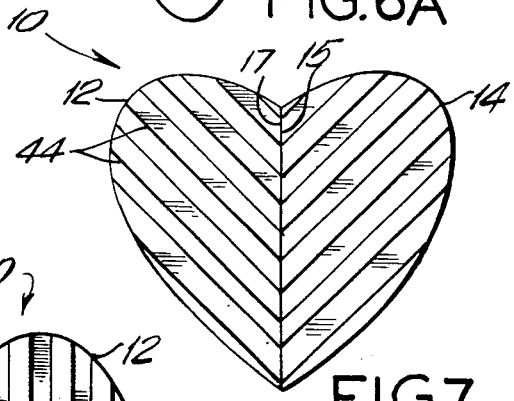
FIG. 7 is a front view of the device of the invention showing a heart shape with a straight line design.
Figure 8:
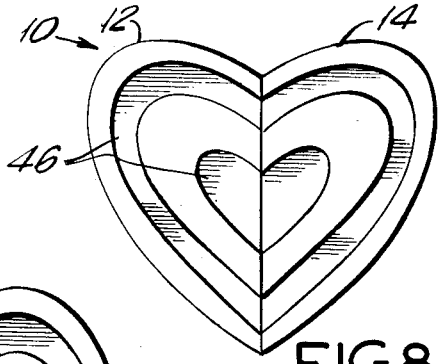
FIG. 8 is a front view of the device of the invention showing a heart shape with curved line design.
Figure 7A:
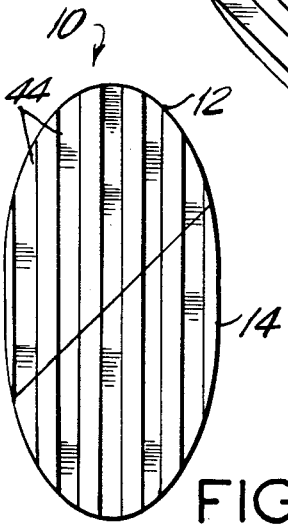
FIG. 7A is a front view of the device of FIG. 7 showing the elliptical shape and what occurs to the design.
Figure 8A:
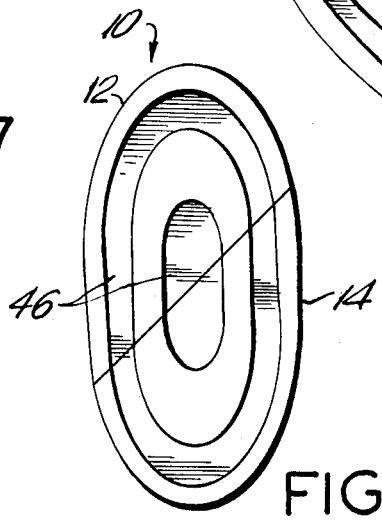
FIG. 8A is a front view of the device of FIG. 8 showing the elliptical shape and the curved design.

The jewelry, charms, lockets, key chain fobs and the like of the invention also can include various designs which produce unique effects when rotated from one position to the other. FIG. 7 shows the novelty 10 with a plurality of a straight lines 44 while in the heart position. The lines 44 meet at the plane ends 15 and 17 of lobes 12 and 14 in a "V" shape. However, when rotated to the ellipse position as in FIG. 7A the lines 44 of each lobe 12 and 14 are aligned longitudinally. This effect may be provided by manufacturing the invention with inlaid metals or plastics. FIGS. 8 and 8A show a similar effect with the inlaid materials design conforming to the shape of the device. Curved lines 46 produce concentric heart (FIG. 8) or ellipse (FIG. 8A) designs depending on the positions the wearer chooses.

Figure 9:
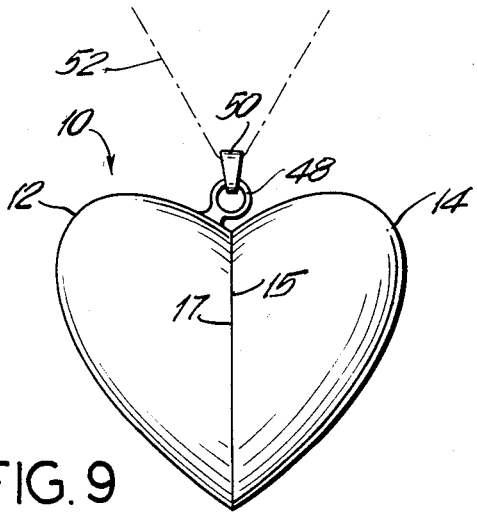
FIG. 9 is a front view of the device of the invention centrally attached to a necklace while in the heart shape position.
Figure 9A:
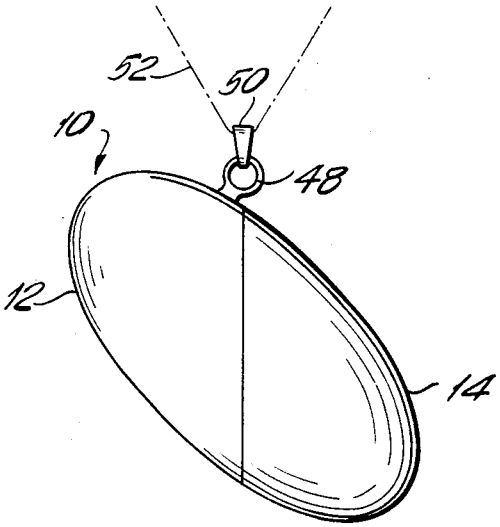
FIG. 9A is a front view of the device of FIG. 9 in the elliptical position.

In the embodiment of the invention of FIGS. 9, 9A, 10, and 10A, there is shown various ways of connecting the novelty 10 to a necklace. In FIGS. 9 and 9A, a ring 48 is connected at its base to the lobe 12 adjacent the plane end 15 and offset from the base so that the ring 48 is centrally positioned and directly above the plane end 15. In this way, when the ring 48 is connected to a similar ring 50 of a necklace 52, the novelty 10 will depend vertically therefrom when it is in its heart shaped configuration. In FIG. 9A, the novelty 10 has been rotated to its other position and is elliptical in configuration.

Figure 10:
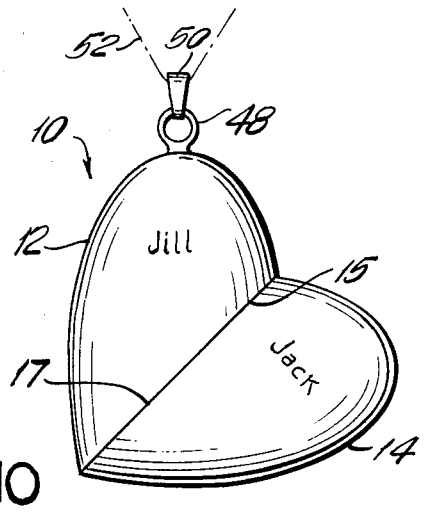
FIG. 10 is a front view of the device of the invention having one lobe attached to the necklace while in the heart shape position.
Figure 10A:
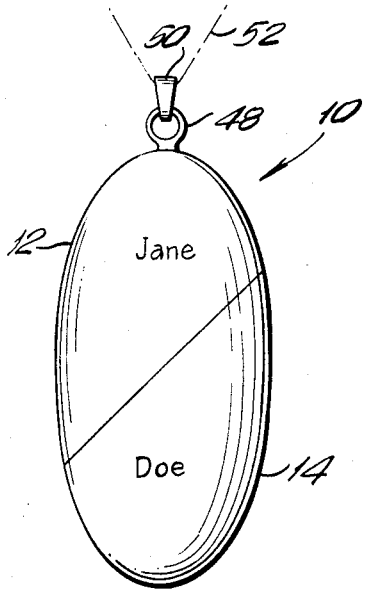
FIG. 10A is a front view of the device of FIG. 10 in the elliptical position.

Similarly, FIGS. 10 and 10A show the hanging positions of the novelty 10 in the heart and mystery positions when the ring 48 is integral with lobe 12 near an end opposite the plane end 15. FIGS. 10 and 10A also show how the novelty 10 can be inscribed with names. While in the elliptical position shown in FIG. 10A, only one name appears. However, a single rotation of lobe 14 to the heart position (FIG. 10) reveals a second name which can indicate the wearer has a "sweetheart". Thus, the novelty 10 is the mystery heart which can be a versatile article of jewelry with various shapes and hanging positions, and with different identification means.

Figure 11:
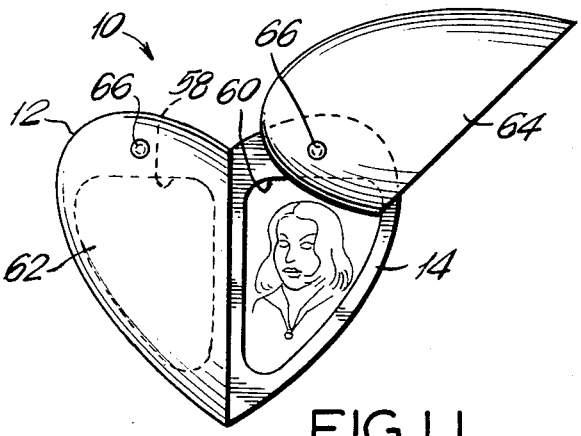

Referring now to FIG. 11, there is shown the novelty 10 as a locket for photographs. In this embodiment, each lobe 12 and 14 has recesses or compartments 58 and 60 for photographs, and slidably hinged covers 62 and 64 which open and close the compartments 58 and 60 as they move about their respective hinge 66. When desired, the locket may include four recesses—two in the front and thus in the back of the pair of lobes of the multilobe novelty 10. The novelty 10 of FIG. 11 also can be used as a small jewelry box. In this instance, the novelty commonly will have two compartments 58 and 60 which can serve as deeper chambers for the jewelry and the like.

The device of the present invention can be made from a wide variety of materials, including metal and plastic. In each embodiment, the device can be used or worn in different positions. In the preferred and illustrative embodiments, the invention can be an alternative piece of jewelry either as an ellipse (mystery) or as a heart, i.e., the MYSTERY HEART. The illustrative embodiments of the invention include a pair of opposed lobes generally parabolic in shape and having a plane end. The lobes are mated together along the plane ends such that when contiguous to each other there is formed either a heart or an ellipse. A pivoting means centered both vertically and horizontally holds the lobes tightly compressed while permitting the lobes to be rotated to the different positions. Hanging rings are strategically placed to allow for varying positions as the device is hung from a necklace.

The rotational ability of the device allows for numerous designs and uses. Name identification may be provided where in the ellipse position the full name of the wearer is displayed and in the heart position the first name of the wearer and a sweetheart is shown. Additionally, straight line and curved designs, such as may be provided by inlaid materials, will result in different symmetrical designs depending on the positions of the device.

Furthermore, the lobes are provided with chambers in a second embodiment to permit the device to be used as a pillbox. Access to the chamber is obtained while the lobes are perpendicular to each other. A third embodiment provides two photo compartments in each lobe with hinged covers for use as a locket.

While preferred embodiments of the subject invention have been described and illustrated, it is obvious that various changes and modifications can be made therein without departing from the spirit of the present invention which should be limited only by the scope of the appended claims.

I claim:

1. A novelty comprising:

a pair of arcuate lobes, each of said lobes having a plane end, said plane ends being positionable with their edges contiguous to each other; and means interconnecting said lobes in pivoting relationship with said plane ends urged into mutual contact which permit said lobes to be rotated from a first stable position in which the lobes form an ellipse configuration, to a second stable position in which the lobes form a heart configuration.

2. A novelty as in claim 1, wherein the lobes are substantially parabolic.

3. A novelty as in claim 1, wherein the interconnecting means comprises in one of said lobes a threaded bore in which a set screw is threaded, a partially threaded through bore in the other of said lobes, a bolt enclosed by a spring which is inserted in said through bore and screwed into said threaded bore and a plug screwed into said threaded portion of said through bore.

4. A novelty as in claim 1, wherein the interconnecting means comprises in one of said lobes a threaded bore in which a set screw is threaded, the other said lobe having a recess in the plane end and a central bore through which the set screw extends therein, a pivot plate positioned in said recess and a spring and locknut enclosing said set screw and interposed in said central bore.

5. A novelty as in claim 1, wherein one of said lobes includes an integral hanging ring adjacent said plane end.

6. A novelty as in claim 1, wherein one of said lobes includes an integral hanging ring opposite said plane end.

7. A novelty as in claim 1, wherein both of said lobes include a plurality of visible lines on the outer surface of said lobes such that the lines meet along the plane ends of said lobes when the lobes are in said first and second position.

8. A novelty as in claim 7, wherein the plurality of lines are curved to conform to the shape of the lobes.

9. A novelty as in claim 1, wherein the lobes include names visible on the outer surface of said lobes such that while in said first position, the first and last name of the wearer are visible from one vantage point and while in said second position, a name of the wearer and of another are visible from the same vantage point.

10. A novelty comprising:

a pair of arcuate lobes, each of said lobes having a plane end, said plane ends being positionable with their edges contiguous to each other, each of said lobes having a chamber with an opening intermediate with said plane ends and a cap covering said opening; and means interconnecting said lobes in pivoting relationship with said plane ends urged into mutual contacts which permit said lobes to be rotated from a first stable position in which the lobes form an ellipse, to a second stable position in which the lobes form a heart, and to a third stable position in which the lobes are in planes perpendicular to each other exposing said caps to said chambers to permit the opening and closing of said caps for the storage of pills, jewelry and the like.

11. A novelty device comprising:

a pair of arcuate lobes, each of said lobes having a plane end, said plane ends being positionable with their edges contiguous to each other, each of said lobes having opposed compartments, said compartments including a slidably secured cover which can be slide open to reveal a photo or the like contained in said compartment; and means interconnecting said lobes in pivoting relationship with said plane ends urged into mutual contact which permit said lobes to be rotated from a first stable position in which the lobes form an ellipse to a second stable position in which the lobes form a heart.

* * * * *